US006243556B1

(12) United States Patent
Shin

(10) Patent No.: US 6,243,556 B1
(45) Date of Patent: Jun. 5, 2001

(54) CLAW APPARATUS FOR LIQUID ELECTROPHOTOGRAPHIC PRINTER

(75) Inventor: Seong-soo Shin, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/471,005

(22) Filed: Dec. 23, 1999

(30) Foreign Application Priority Data

Mar. 15, 1999 (KR) ..... 99-8588

(51) Int. Cl.[7] ..... G03G 15/00
(52) U.S. Cl. ..... 399/323; 271/309; 271/311
(58) Field of Search ..... 399/322, 323, 399/307; 271/307, 309, 311, 312, 900

(56) References Cited

U.S. PATENT DOCUMENTS 3,784,190 * 1/1974 Crawford ..... 271/80
3,981,085 * 9/1976 Franko .
4,061,330 * 12/1977 Yanagawa ..... 271/174
4,364,657 * 12/1982 Landa .
4,420,152 * 12/1983 Miyashita ..... 271/309
5,406,363 * 4/1995 Siegel .

FOREIGN PATENT DOCUMENTS 51-104350 9/1976 (JP) .
58-74265 5/1983 (JP) .
8-227227 9/1996 (JP) .

* cited by examiner

*Primary Examiner*—Richard Moses
(74) *Attorney, Agent, or Firm*—Sughrue, Mion, Zinn, Macpeak & Seas, PLLC

(57) ABSTRACT

A claw apparatus for a liquid electrophotographic printer prevents a sheet of paper passing through a transfer roller and the fixation roller from adhering to and curling around the transfer roller due to a peel force. In the claw apparatus, a guide portion guides the paper passing between the transfer roller and the fixation roller. A curved portion encompasses a portion of an outer circumferential surface of the transfer roller. An injection portion, formed at the curved portion, injects air through a gap formed between the curved portion and the transfer roller so that the paper passing between the transfer roller and the fixation roller can be guided toward the guide portion.

2 Claims, 5 Drawing Sheets

CLAW APPARATUS FOR LIQUID ELECTROPHOTOGRAPHIC PRINTER

BACKGROUND OF THE INVENTION

1. Field of the Invention

The present invention relates to a claw apparatus for a liquid electrophotographic printer and, more particularly, to a claw apparatus for a liquid electrophotographic printer which can prevent a paper jam phenomenon from occurring as a sheet of paper passing between a transfer roller and a fixation roller adheres on and is rolled on the surface of the transfer roller by a peel force.

2. Description of the Related Art

In a typical liquid electrophotographic printer, an electrostatic latent image formed on a photoreceptor medium, such as a photoreceptor web, is developed with developer having a predetermined color, and a toner image formed on the photoreceptor medium is transferred to a sheet of paper to print a desired image.

As shown in FIG. 1, the typical liquid electrophotographic printer includes a photoreceptor medium 1 circulating in a direction indicated by arrow A, and a development unit 2 disposed under the photoreceptor medium 1. An electrostatic latent image is formed by a laser scanning unit LSU (not shown) on the surface of the photoreceptor medium 1. The electrostatic latent image is developed by toner of the developer injected by the development unit 2 and a toner image is formed. The toner image is transferred to a sheet of paper 7 by a transfer unit 10. The transfer unit 10 includes a transfer roller 3 for receiving the toner image formed on the photoreceptor medium 1 due to the difference in surface energy between the photoreceptor medium 1 and the transfer roller 3, and a fixation roller 4 for pressing the transfer roller 3 to transfer the image on the transfer roller 3 to the paper 7 utilizing the difference in surface energy between the transfer roller 3 and the paper 7. Reference numeral 5 denotes a backup roller for supporting the photoreceptor medium 1 and guiding circulation of the photoreceptor medium 1.

As it is well-known, not only the surface of the photoreceptor medium 1 can be charged by a charger (not shown), but also the level of electric potential of the surface of the photoreceptor medium 1 can be selectively converted by beam scanning of the laser scanning unit. In a typical liquid electrophotographic printer, the entire surface of the photoreceptor medium 1 is charged by a corona charge to an electric potential of about 600 volts and the electric potential of the surface of the photoreceptor medium 1 is selectively dropped to about 150 volts by the laser scanning unit, so that a predetermined electrostatic latent image is formed. When toner charged to the electric potential of about 450 volts is added to the above electrostatic latent image, the toner adheres to only a portion where the level of electric potential is dropped and accordingly an image is formed.

A conventional claw apparatus 6 is installed adjacent to the transfer roller 3 to prevent a jam occurring as the paper 7 passing between the transfer roller 3 and the fixation roller 4 proceeds while adhering to the surface of the transfer roller 3 due to a peel force. This is because the jam phenomenon can be prevented when the leading end of the claw apparatus 6 is disposed at least at a point where the leading end of the paper 7 is separated about 0.5 mm from a contact point between the transfer roller 3 and the fixation roller 4. However, as the leading end of the claw apparatus 6 has a mechanical allowance of ±0.2 mm, the jam phenomenon is difficult to eliminate unless the claw apparatus 6 is precisely processed. Also, to provide an additional unit to prevent the jam phenomenon makes the structure of the printer more complicated.

SUMMARY OF THE INVENTION

To solve the above problems, it is an objective of the present invention to provide a claw apparatus for a liquid electrophotographic printer having an improved structure in which a claw is configured into two pieces forming an injection hole and simultaneously air can be injected through the injection hole so that the above paper jam phenomenon can be prevented.

Accordingly, to achieve the above objective, there is provided a claw apparatus for a liquid electrophotographic printer for preventing a sheet of paper passing through a transfer roller and the fixation roller from adhering to and curling around the transfer roller due to a peel force, in which the claw apparatus includes a guide portion which guides the paper passing between the transfer roller and the fixation roller, a curved portion encompassing a portion of an outer circumferential surface of the transfer roller, and an injection portion, formed at the curved portion, which injects air through a gap formed between the curved portion and the transfer roller so that the paper passing between the transfer roller and the fixation roller can be guided toward the guide portion.

It is preferable in the present invention that a plurality of indentations are formed on the surface of the guide portion to prevent damage to an image transferred to the paper.

Also, it is preferable in the present invention that the injection portion is formed by coupling a first piece where an air path is formed and a second piece where an injection inlet connected to the air path is formed.

Also, it is preferable in the present invention that the first piece further comprises a support portion integrally formed with the first piece so that the first piece can be supported by both ends of the transfer roller.

Also, it is preferable in the present invention that a plurality of coupling holes operative to be coupled to a main body of the printer are formed in the second piece to prevent deformation of the second piece.

BRIEF DESCRIPTION OF THE DRAWINGS

The above objective and advantages of the present invention will become more apparent by describing in detail a preferred embodiment thereof with reference to the accompanying drawings, in which.

DETAILED DESCRIPTION OF THE INVENTION

Figure 1:
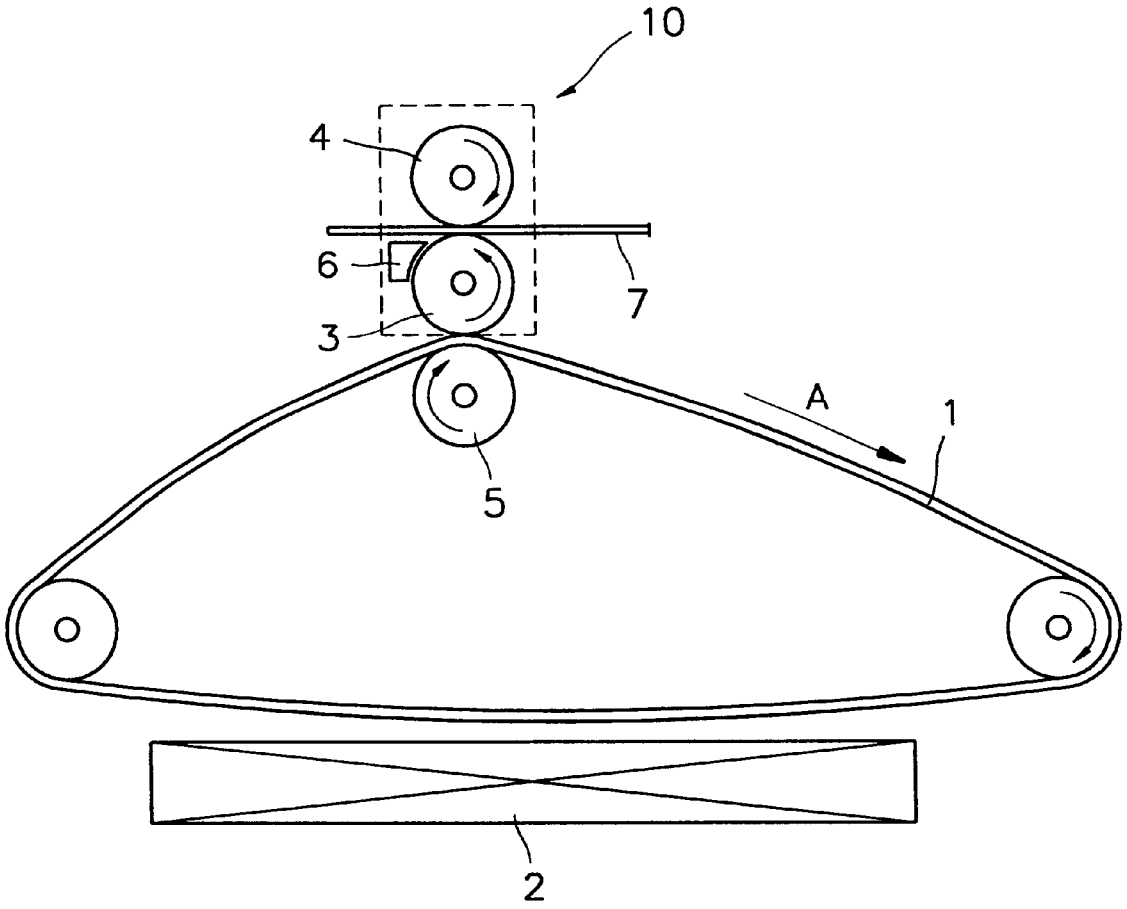
FIG. 1 (PRIOR ART)
FIG. 1 is a view showing the structure of the major portion of a claw apparatus for a conventional liquid electrophotographic printer.
Figure 2:
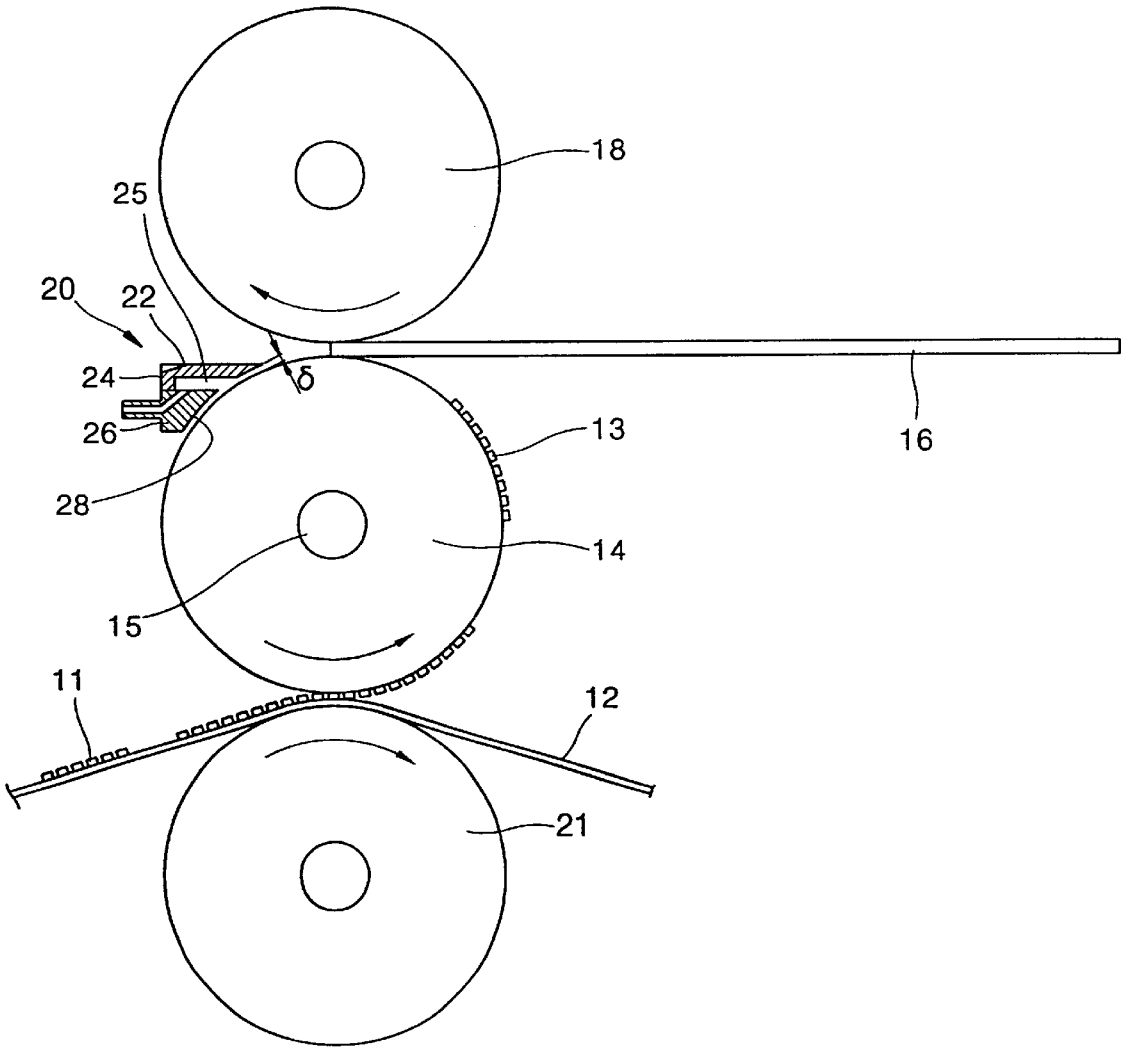
FIG. 2 is a sectional view showing a claw apparatus for a liquid electrophotographic printer according to a preferred embodiment of the present invention.

Referring to FIG. 2, a claw apparatus 20 is provided for preventing a sheet of paper 16 exiting between a transfer roller 14 and a fixation roller 18 from adhering to and curling around the surface of the transfer roller 14. The claw apparatus 20 is installed on a discharging path of the paper 16, adjacent to a gap formed between the transfer roller 14 and the fixation roller 18. The transfer roller 14 is installed to closely contact a photoreceptor medium 12. The fixation roller 18 presses the paper 16 toward the transfer roller 14 such that an image 13 on the surface of the transfer roller 14 is transferred to the paper 16.

The photoreceptor medium 12 circulates on an endless path by being supported by a plurality of rollers (not shown) including a backup roller 21 and a toner image 11 developed on the surface of the photoreceptor medium 12 is transferred to the surface of the transfer roller 14. The transfer roller 14 contacts the photoreceptor medium 12 during printing, but is separated therefrom by a predetermined elevating device (not shown) to protect the photoreceptor medium 12 when printing temporarily stops or the power is turned off. The interval between the transfer roller 14 and the fixation roller 18 is adjustable according to the thickness of a sheet of paper supplied. Also, when printing is not performed, the fixation roller 18 is separated from the transfer roller 14. The transfer roller 14 and the fixation roller 18 each are made by coating an aluminum core shaft 15 with rubber.

Figure 3:
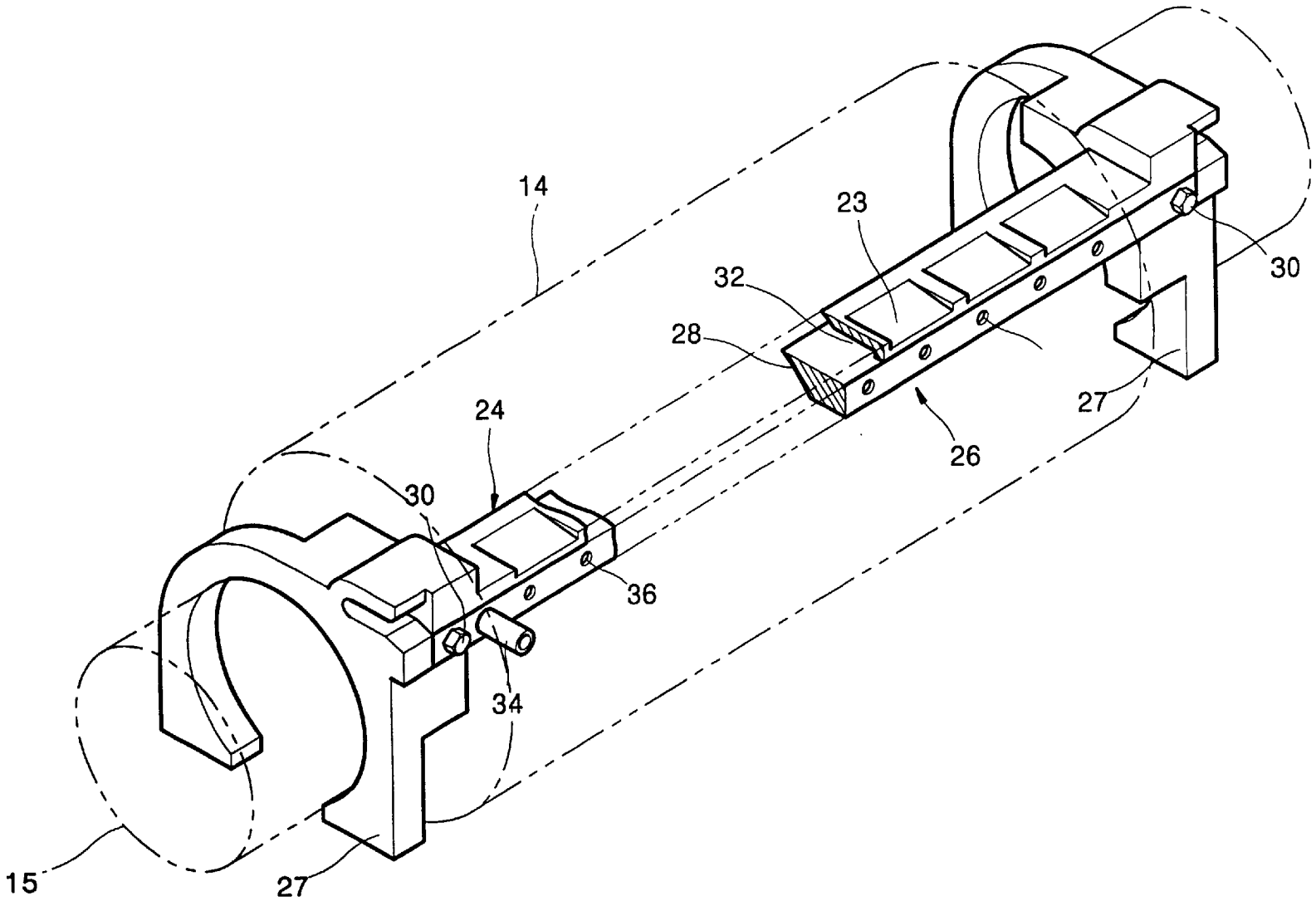
FIG. 3 is a perspective view showing the claw apparatus shown in FIG. 2.
Figure 4:
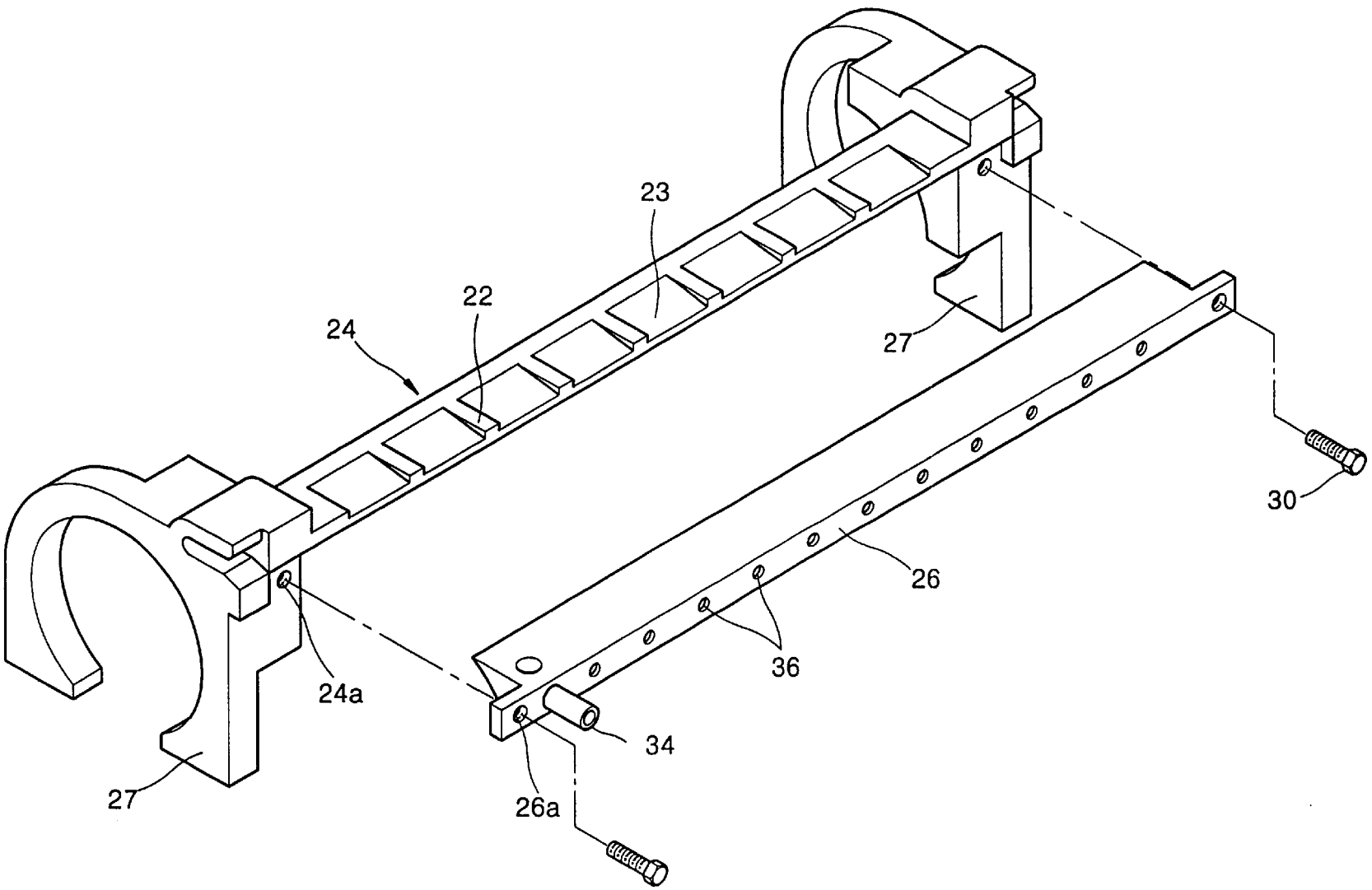
FIG. 4 is an exploded view showing the claw apparatus shown in FIG. 3.
Figure 5:
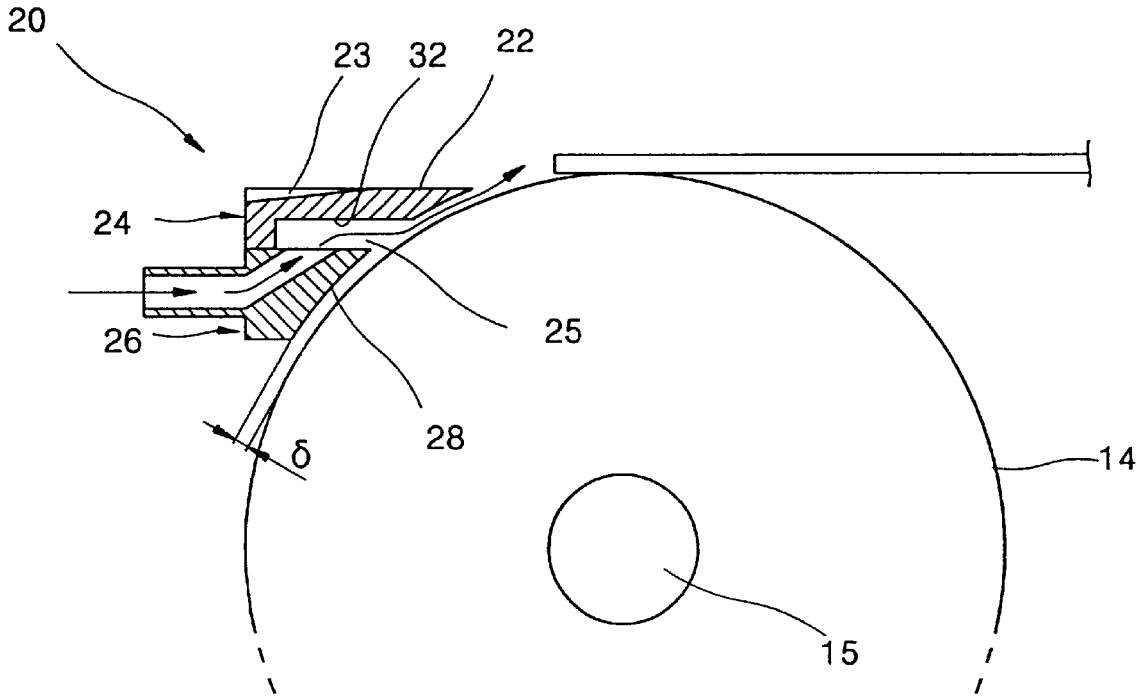
FIGS. 5 and 6 are views for explaining the operation of the claw apparatus for a liquid electrophotographic printer according to the preferred embodiment of the present invention.
Figure 6:
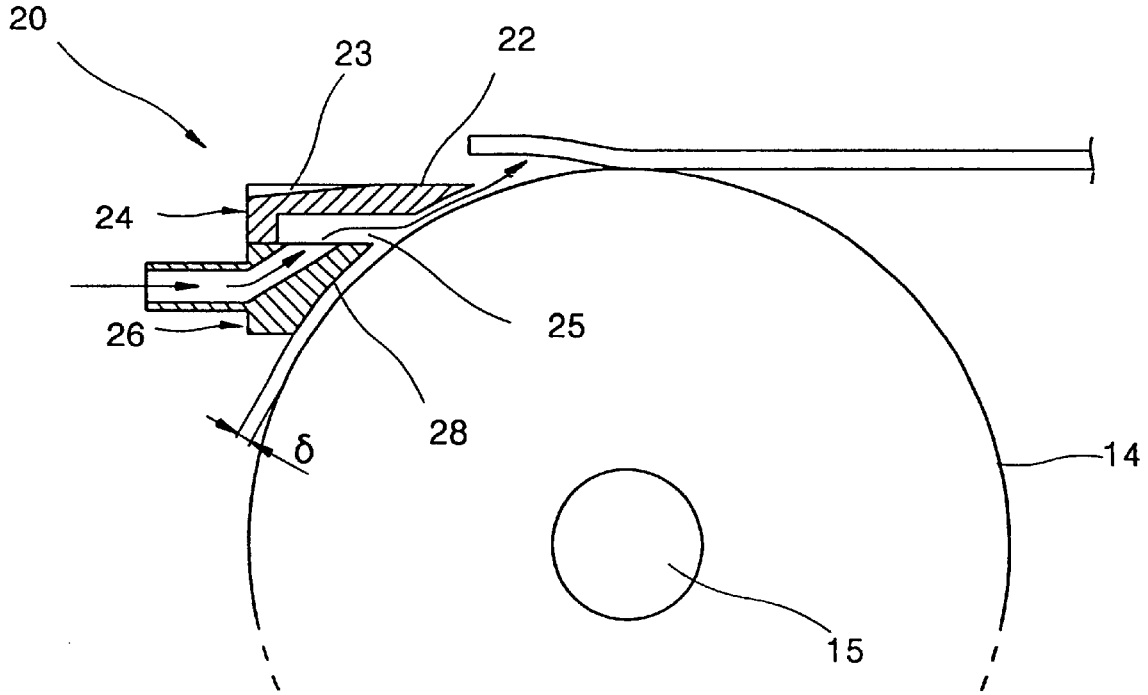

The claw apparatus 20, as shown in FIG. 2 through FIG. 4, includes a first piece 24 where a guide portion 22 for guiding the paper 16 is formed, and a second piece 26 coupled to the first piece 24 by bolts 30 and forming an injection portion 25 of a predetermined shape. Thus, bolt holes 24*a* and 26*a* are formed at both sides of the first and second pieces 24 and 26. A plurality of indentations 23 to prevent damage of the image 13 transferred from the transfer roller 14 to the paper 16 are formed on the guide portion 22. The indentations 23 are for minimizing the area of the guide portion 22 to contact the paper 16. A support portion 27, which is slidably supported with respect to each end of the rotatable core shaft 15 of the transfer roller 14, is integrally formed at both ends of the first piece 24.

A curved portion 28 encompassing a portion of the outer circumferential surface of the transfer roller 14 is formed on the claw apparatus 20. The curved portion 28 is formed both on the first piece 24 and the second piece 26 and is designed to be parallel to the outer circumferential surface of the transfer roller 14 in the state in which the first and second pieces 24 and 26 are coupled to each other. The injection portion 25 is formed by coupling the first piece 24 and the second piece 26 together. That is, an air path 32 is inwardly formed in the first piece 24 facing the second piece 26 and one end of the air path 32 is blocked by the second piece 26 so that the injection portion 25 is formed.

An injection inlet 34 is formed in the second piece 26. The injection inlet 34 receives air from an air injection device such as an external air pump (not shown) and supplies the received air through the air path 32. To prevent deformation of the claw apparatus 20 in the lengthwise direction, a plurality of coupling holes 36 are formed in the second pieces 26. Coupling protrusions (not shown) installed at a main body of the printer (not shown) are inserted in the coupling holes 36 such that the coupling protrusions hold the claw apparatus 20 in a stationary state.

In the operation of the claw apparatus for a liquid electrophotographic printer having the above structure according to the present invention, referring to FIGS. 2 through 6, first, when the support portion 27 of the claw apparatus 20 is supported by the shaft 15 of the transfer roller 14, a gap δ, and is formed between the curved portion 28 and the outer circumferential surface of the transfer roller 14. In this state, the air pump is operated and air is injected through the injection inlet 34. The air is injected through the injection portion 25, guided by the gap δ, and injected into the upper portion of the first piece 24. Then, the air is injected toward the leading end of the paper 16 passing between the transfer roller 14 and the fixation roller 18 to lift the leading end of the paper 16. Thus, the interval between the leading end of the paper 16 and the transfer roller 14 increases so that the change to adhesion of the paper 16 to the surface of the transfer roller 14 decreases. Consequently, when the paper 16 is continuously discharged between the transfer roller 14 and the fixation roller 18, as the paper 16 is guided by the guide portion 22, a jam phenomenon does not occur. Here, as the indentation 23 formed in the guide portion 22 minimizes the area of the guide portion 22 contacting the paper 16, damage to the image transferred to the surface of the paper 16 can be minimized.

As described above, the claw apparatus according to the present invention has advantages as follows.

First, by adding an air supply device to the conventional claw apparatus used for separating the paper from the transfer roller, the paper can be easily separated from the transfer roller.

Second, as the main body is formed by a two piece structure to facilitate the design of the claw apparatus and air is injected through the injection portion formed by coupling two pieces, the problem caused by the mechanical allowance of the claw apparatus itself can be solved. Also, there is no need to additionally install a paper separation apparatus such as an additional injection nozzle.

It is contemplated that numerous modifications may be made to the claw apparatus for liquid electrophotographic printer of the present invention without departing from the spirit and scope of the invention as defined in the following claims.

What is claimed is:

1. A claw apparatus for a liquid electrophotographic printer for preventing a sheet of paper passing through a transfer roller and a fixation roller from adhering to and curling around the transfer roller due to a peel force, the claw apparatus comprising:

a guide portion which guides the paper passing between the transfer roller and the fixation roller;

a curved portion encompassing a portion of an outer circumferential surface of the transfer roller; and an injection portion, formed at said curved portion, which injects air through a gap formed between said curved portion and the transfer roller so that the paper passing between the transfer roller and the fixation roller is guided toward said guide portion, wherein said injection portion is formed by coupling a first piece where an air path is formed and a second piece where an injection inlet connected to the air path is formed, and wherein said first piece further comprises a support portion integrally formed with said first piece so that said first piece is supported by both ends of the transfer roller.

2. A claw apparatus for a liquid electrophotographic printer for preventing a sheet of paper passing through a transfer roller and a fixation roller from adhering to and curling around the transfer roller due to a peel force, the claw apparatus comprising:

a guide portion which guides the paper passing between the transfer roller and the fixation roller;

a curved portion encompassing a portion of an outer circumferential surface of the transfer roller; and an injection portion, formed at said curved portion, which injects air through a gap formed between said curved portion and the transfer roller so that the paper passing between the transfer roller and the fixation roller is guided toward said guide portion, wherein said injection portion is formed by coupling a first piece where an air path is formed and a second piece where an injection inlet connected to the air path is formed, and wherein a plurality of coupling holes operative to be coupled to a main body of the printer are formed in said second piece to prevent deformation of said second piece.

* * * * *